US006368764B2

(12) United States Patent
Tokutake et al.

(10) Patent No.: US 6,368,764 B2
(45) Date of Patent: Apr. 9, 2002

(54) PHOTOSENSITIVE MEMBER FOR ELECTROPHOTOGRAPHY

(75) Inventors: Shigeaki Tokutake, Takatsuki; Keiichi Inagaki, Itami; Teiko Edo, Kawanishi, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/741,075

(22) Filed: Dec. 21, 2000

(30) Foreign Application Priority Data

Dec. 22, 1999 (JP) ..... 11-364334

(51) Int. Cl.[7] ..... G03G 5/14
(52) U.S. Cl. ..... 430/66; 430/132
(58) Field of Search ..... 430/66, 67, 132

(56) References Cited

U.S. PATENT DOCUMENTS

| | | | | |
|---|---|---|---|---|
| 5,024,913 A | | 6/1991 | Yoshida et al. | 430/67 |
| 5,260,157 A | | 11/1993 | Mizuta et al. | 430/66 |
| 5,912,098 A | | 6/1999 | Tanaka et al. | 430/67 |
| 5,976,743 A | * | 11/1999 | Yamaki et al. | 430/58.2 |

FOREIGN PATENT DOCUMENTS

| | | |
|---|---|---|
| JP | 61-51155 | 3/1986 |
| JP | 3-141365 | 6/1991 |
| JP | 3-211561 | 9/1991 |

* cited by examiner

*Primary Examiner*—John Goodrow
(74) *Attorney, Agent, or Firm*—McDermott, Will & Emery

(57) ABSTRACT

The present invention provides a photosensitive member for electrophotography which has excellent adhesion between a surface protective layer and a photosensitive layer as well as electrostatic properties, such as sensitivity and the like, and which prevents an occurrence of an image noise over a long period of time.

The photosensitive member for electrophotography which comprises:

(i) an electroconductive support, (ii) an organic photosensitive layer which comprises a charge generating material, a charge transporting material, and a binder resin, and (iii) a surface protective layer which comprises a thermosetting silicone resin, said surface protective layer being prepared by applying a coating solution comprising the thermosetting silicone resin and a solvent, which can dissolve the binder resin and has a boiling point of 60–130° C. and a solubility parameter of 8–11, onto the organic photosensitive layer and then curing the applied coating solution.

20 Claims, No Drawings

PHOTOSENSITIVE MEMBER FOR ELECTROPHOTOGRAPHY

This application is based on the application No. 364334/1999 filed in Japan, the contents of which are hereby incorporated by reference.

BACKGROUND OF THE INVENTION

1. Field of the Invention

The present invention relates to a photosensitive member for electrophotography.

2. Description of the Related Art

In the photosensitive member which is recently employed for an electrophotographic equipment, such as an image forming equipment and the like, it is a general technical matter to form a surface protective layer on a surface of an organic photosensitive layer from the viewpoints of preventing an abrasion of the photosensitive layer caused by a cleaning member and the like as well as an injection of a surface charge into the photosensitive layer.

Silicone resin has been known as a material to form the surface protective layer, said silicone resin being constituted by a three-dimensional network of siloxane bond (Si—O—Si bond). However, in the case where the silicone resins are independently employed, a problem of the adhesion between the photosensitive layer and the protective layer has been occurred because the inorganic material is laminated on the organic material, said problem being caused by a difference of a coefficient of thermal expansion between both materials.

Accordingly, a surface protective layer which consists of the silicone resin and a thermoplastic resin has been proposed. However, this proposal brings about the various problems that a sensitivity is worse, an electric potential increases at the time of plate wearing, and an image noise, such as a fog, and image flowing and the like are brought about on the image quality.

In addition, at the time of forming the surface protective layer, it is a general technical matter to apply a coating solution for the surface protective layer which is prepared by dissolving the material for the protective layer such as the silicone resin as well as optional thermoplastic resin and the like in a solvent is applied on the organic photosensitive layer and to cure the applied coating solution. Furthermore, in order to avoid a formation of ununiform interface between the surface protective layer and the photosensitive layer, said formation being caused by a dissolution of the organic photosensitive layer at the time of forming the surface protective layer, it is a general technical matter to employ a solvent which does not dissolve the materials for the photosensitive layer, such as the binder resin, photoconductive material and the like, for example, alcohols, such as methanol, ethanol, 2-propanol and the like (see, for example, Japanese Patent Publication (Kokai) Nos. 51155/1986, 141365/1991, 211561/1991). When the interface between the surface protective layer and the photosensitive layer becomes ununiform, a difference will occur depending on a part of one photosensitive member with respect to the qualities, such as the adhesion between the surface protective layer and the photosensitive layer, the electrostatic properties and the like, said difference bringing about a problem that it becomes a cause of the image noise, such as a image shading and the like.

SUMMARY OF THE INVENTION

The present invention has been carried out in view of the aforementioned situation.

The object of the present invention is to provide a photosensitive member for electrophotography which has excellent adhesion between a surface protective layer and a photosensitive layer as well as electrostatic properties, such as sensitivity and the like, and which prevents an occurrence of an image noise over a long period of time.

The present invention relates to a photosensitive member for electrophotography which comprises:

(i) an electroconductive support, (ii) an organic photosensitive layer which comprises a charge generating material, a charge transporting material, and a binder resin, and (iii) a surface protective layer which comprises a thermosetting silicone resin, said surface protective layer being prepared by applying a coating solution comprising the thermosetting silicone resin and a solvent, which can dissolve the binder resin and has a boiling point of 60–130° C. and a solubility parameter of 8–11, onto the organic photosensitive layer and then curing the applied coating solution.

DETAILED DESCRIPTION OF THE INVENTION

The photosensitive member for electrophotography of the present invention is prepared by laminating at least the organic photosensitive layer and the surface protective layer on the electroconductive support in this order. According to the present invention, the specific solvent is employed when the surface protective layer is formed.

To say more precisely, the surface protective layer of the present invention is formed by applying the coating solution for the surface protective layer comprising the specific solvent and the thermosetting silicone resin onto the organic photosensitive layer and then curing the applied coating solution. The coating solution is prepared by dissolving at least the thermosetting silicone resin in the specific solvent.

The solvent employed in the present invention can dissolve the organic photosensitive layer on which the surface protective layer is directly formed or can dissolve at least the binder resin which is one of the components of the organic photosensitive layer, and has the boiling point (under a pressure of 760 mmHg) of 60–130° C., preferably 60–120° C., more preferably 65–115° C. as well as the solubility parameter of 8–11, preferably 8.5–10.5, more preferably 8.5–10. It is thinkable that the adhesion between the surface protective layer and the organic photosensitive layer as well as the electrostatic properties, such as the sensitivity and the like can be improved and the occurrence of the image noise can be prevented over a long period of time because the materials of the organic photosensitive layer can uniformly penetrate into the surface protective layer without making the interface between the surface protective layer and the organic photosensitive layer ununiform by forming the surface protective layer with the specific solvent.

In the present specification, the wording of "the interface between the surface protective layer and the organic photosensitive layer becomes ununiform" means that a clear boundary is not formed between the surface protective layer and the organic photosensitive layer, and a layer wherein the components of the surface protective layer and the organic photosensitive layer exist ununiformly is formed in the region situated in the neighborhood of the boundary between the surface protective layer and the organic photosensitive layer. Although the clear boundary is not formed between the surface protective layer and the organic photosensitive layer in the present invention, it is thinkable that the object of the present invention can be achieved because a layer wherein the components of both layers exist in a comparatively uniform manner is formed between both layers.

As regards the solvent, the wording of "can dissolve the organic photosensitive layer" used in the present specification means that the solvent dissolve the organic photosensitive layer or at least the binder resin of the organic photosensitive layer when the surface protective layer is formed in such a way that the surface protective layer to be prepared has an aftermentioned gradient of ionization potential energy in the inside thereof. When the binder resin is excessively dissolved in the solvent, the formation of the surface protective layer becomes difficult. On the other hand, when the solubility of the binder resin in the solvent is lowered to an undue extent, it is impossible to obtain the effects of the present invention that the adhesion between the surface protective layer and the organic photosensitive layer as well as the electrostatic properties, such as the sensitivity and the like are improved, and that the occurrence of the image noise is prevented over a long period of time. In the case where the organic photosensitive layer on which the surface protective layer is directly formed contains no binder resin, although it is sufficient to dissolve the photoconductive materials of the organic photosensitive layer, such as the charge generating material and the charge transporting material under the aforesaid conditions, the object of the present invention can be achieved more effectively when the organic photosensitive layer on which the surface protective layer is directly formed contains the binder resin.

When the boiling point of the solvent is less than 60° C., an ununiform interface is formed between the surface protective layer and the organic photosensitive layer to make the quality of the photosensitive member ununiform, and the formation of the surface protective layer becomes impossible, since the coating solution for forming the surface protective layer is easily gelled. On the other hand, the boiling point of the solvent exceeds 130° C., the solvent shows a marked tendency to cause the increase of the residual electric potential as well as the occurrence of the fog and the image flowing on the image at the time of plate wearing.

In addition, when the solubility parameter of the solvent is less than 8 or exceeds 11, the adhesion between the surface protective layer becomes worse, and the charge injection from the organic photosensitive layer to the surface protective layer becomes worse to lower the sensitivity. In particular, when said solubility parameter is less than 8, the formation of the surface protective layer becomes impossible, since the coating solution for forming the surface protective layer is easily gelled. On the other hand, when said solubility parameter exceeds 11, the solvent shows a marked tendency to cause the occurrence of the fog and the image flowing on the image at the time of plate wearing under the hot and humid circumstance.

The following solvents are exemplified as the solvent employed in the present invention: benzene, chloroform, cyclohexane, 1,2-dichloroethane, 1,4-dioxane, nitromethane, pyridine, carbon tetrachloride, tetrahydrofuran, toluene, methyl isobutyl ketone, ethyl acetate, methyl ethyl ketone and the like. Preferably, 1,4-dioxane, tetrahydrofuran and toluene are employed. The solvent may contain not more than 10% by weight of water.

The solubility parameter used in the present specification is the intrinsic value of physical properties of each solvent, said value representing an intermolecular force which corresponds to a square root of cohesive energy density (C.E.D.) as shown in the following equation. More particularly, the solubility parameter represents an energy which is necessary for physically evaporating 1 cc of the solvent.

$$(\text{solubility parameter})^2=\Delta E/V=(\Delta H-RT)/V=(\Delta H-RT)C/M$$

ΔE: evaporation energy (cal/Mol)

V: molecular volume (cc/Mol)

ΔH: evaporation latent heat

R: gas constant (cal/Mol)

C: density (g/cc)

M: gram molecular weight (g/Mol)

T: absolute temperature

From the viewpoints of the more improved adhesion between the surface protective layer and the organic photosensitive layer as well as the stability of the coating solution for the surface protective layer, the desirable amount of the aforesaid solvent used is 5–35 parts by weight, preferably 10–30 parts by weight in relation to 100 parts by weight of the aftermentioned thermosetting silicone resin.

As the thermosetting silicone resin used in the present invention, it is preferable to employ the silicone resin which can form the structure wherein the siloxane bonds are three-dimensionally repeated in a later curing process. It is preferable to use the polymers having the polycondensed structure of the organosilane represented by the following general formula (I) [hereinafter referred to as organosilane (I)]:

$$(R^1)_nSi(OR^2)_{4-n} \quad (I)$$

wherein $R^1$ is an organic group having $C_1$–$C_8$, $R^2$ is alkyl group having $C_1$–$C_5$ or acyl group having $C_1$–$C_4$, and n is an integer of 0–2.

As the organic group having $C_1$–$C_8$ of $R^1$ in the general formula (I), the following groups are exemplified: alkyl group, such as methyl group, ethyl group, n-propyl group, i-propyl group, n-butyl group, i-butyl group, sec-butyl group, t-butyl group, n-pentyl group, n-hexyl group, n-heptyl group, n-octyl group and the like, γ-chloropropyl group, γ-bromopropyl group, 3,3,3-trifluoropropyl group, γ-glycidoxypropyl group, γ-(meth)acryloxypropyl group, γ-mercaptopropyl group, γ-aminopropyl group, γ-dimethylaminopropyl group, 2-(3,4-epoxycyclohexyl) ethyl group, vinyl group, phenyl group and the like.

Preferably, $R^1$ is methyl group, ethyl group, n-propyl group, i-propyl group, γ-chloropropyl group, 3,3,3-trifluoropropyl group, γ-glycidoxypropyl group, γ-(meth) acryloxypropyl group, γ-mercaptopropyl group, 2-(3,4-epoxycyclohexyl)ethyl group, vinyl group or phenyl group.

As alkyl group having $C_1$–$C_5$ of $R^2$, methyl group, ethyl group, n-propyl group, i-propyl group, n-butyl group, i-butyl group, sec-butyl group, t-butyl group, n-pentyl group and the like are exemplified. As acyl group having $C_1$–$C_4$ of $R^2$, acetyl group, propionyl group, butylyl group and the like are exemplified. The preferred $R^2$ is methyl group, ethyl group or acetyl group.

In the case where the organosilane (I) wherein n is 2, it is preferable to employ the thermosetting silicone resin which is a mixture of said organosilane together with the organosilane (I) wherein n is 0 and/or 1.

In the present specification, the term of "(meth)acryl" means "acryl" and "methacryl". For example, methyl(meth) acrylate means methylacrylate and methylmethacrylate.

As the preferred organosilane (I), the following compounds are exemplified: alkoxysilanes, such as tetramethoxysilane, tetraethoxysilane, methyltrimethoxysilane, methyltriethoxysilane, ethyltrimethoxysilane, ethyltriethoxysilane, n-propyltrimethoxysilane, n-propyltriethoxysilane, i-propyltrimethoxysilane, i-propyltriethoxysilane, γ-chloropropyltrimethoxysilane, γ-chloropropyltriethoxysilane, 3,3,3-trifluoropropyltrimethoxysilane, 3,3,3-trifluoropropyltriethoxysilane, γ-glycidoxypropyltrimethoxysilane, γ-glycidoxypropyltriethoxysilane, γ-methacryloxypropyltrimethoxysilane, γ-methacryloxypropyltriethoxysilane, γ-mercaptopropyltrimethoxysilane, γ-mercaptopropyltriethoxysilane, 3,4-epoxycyclohexylethyltrimethoxysilane, 3,4-epoxycyclohexylethyltriethoxysilane, vinyltrimethoxysilane, vinyltriethoxysilane, phenyltrimethoxysilane, phenyltriethoxysilane, dimethyldimethoxysilane, dimethyldiethoxysilane, diethyldimethoxysilane, diethyldiethoxysilane, di-n-propyldimethoxysilane, di-n-propyldiethoxysilane, di-i-propyldimethoxysilane, di-i-propyldiethoxysilane, divinyldimethoxysilane, divinyldiethoxysilane, diphenyldimethoxysilane, diphenyldiethoxysilane and the like; acyloxysilanes, such as tetraacetoxysilane, methyltriacetoxysilane, ethyltriacetoxysilane, dimethyldiacetoxysilane, diethyldiacetoxysilane and the like. More preferred organosilanes are methyltrimethoxysilane, methyltriethoxysilane, dimethyldimethoxysilane and dimethyldiethoxysilane. The organosilane (I) may be used independently or may be used as a mixture of two or more of the organosilanes.

In the present invention, the thermosetting silicone resin prepared by the polycondensation of the aforementioned organosilane (I) may have such a number-average molecular weight that said resin is dissolved in the aforesaid solvent to form the solution which can be applied.

The following commercial products can be available as the aforementioned thermosetting silicone resin: NP730 (Nippon Dagrosham Co.), HPC7003 (JSR Co.), GS-600-1 (Fine Glass Technology Co.) and G90 (Nichban Laboratory).

In the present invention, one or more of the aforesaid organosilane (I) may be employed in place of the thermosetting silicone resin. In such a case, it is preferable to carry out the polycondensation of the organosilane (I) by the publicly known method before the coating solution for the surface protective layer is applied on the organic photosensitive layer. The polycondensation may be conducted to such an extent that the polymer of the organosilane (I) to be obtained may have approximately the same number-average molecular weight as that mentioned above of the thermosetting silicone resin.

It is preferable to add the aftermentioned curing accelerator (1) and/or curing accelerator (2) to the coating solution for the surface protective layer. The curing of the thermosetting silicone resin, i.e. the three-dimensionalization of the siloxane bond in the surface protective layer, can be accelerated by the addition of these curing accelerators.

The following compounds are exemplified as the curing accelerator (1): alkali metal salts of naphthenic acid, octylic acid, nitrous acid, sulfurous acid, aluminic acid, carbonic acid and the like; alkaline compounds, such as sodium hydroxide, potassium hydroxide and the like; acidic compounds, such as alkyltitanic acid, phosphoric acid, p-toluenesulfonic acid, phthalic acid and the like; aminic compounds, such as ethylenediamine, hexanediamine, diethylenetriamine, triethylenetetramine, tetraethylenepentamine, piperidine, piperazine, methaphenylenediamine, ethanolamine, triethylamine, various modified amines which are used as a curing agent for epoxy resin, tris(cyclohexylamino)methylsilane, γ-aminopropyltriethoxysilane, γ-(2-aminoethyl)-aminopropyltrimethoxysilane, γ-(2-aminoethyl)-aminopropylmethyldimethoxysilane, γ-anilinopropyltrimethoxysilane and the like; organic tin compounds of carboxylic acid type, such as $(C_4H_9)_2Sn(OCOC_{11}H_{23})_2$, $(C_4H_9)_2Sn(OCOCH{=}CHCOOCH_3)_2$, $(C_4H_9)_2Sn(OCOCH{=}CHCOOC_4H_9)_2$, $(C_8H_{17})_2Sn(OCOC_{11}H_{23})_2$, $(C_8H_{17})_2Sn(OCOCH{=}CHCOOCH_3)_2$, $(C_8H_{17})_2Sn(OCOCH{=}CHCOOC_4H_9)_2$, $(C_8H_{17})_2Sn(OCOCH{=}CHCOOC_8H_{17})_2$, $Sn(OCOCC_8H_{17})_2$ and the like; organic tin compounds of mercaptide type, such as $(C_4H_9)_2Sn(SCH_2COO)_2$, $(C_4H_9)_2Sn(SCH_2COOC_8H_{17})_2$, $(C_8H_{17})_2Sn(SCH_2COO)_2$, $(C_8H_{17})_2Sn(SCH_2CH_2COO)_2$, $(C_8H_{17})_2Sn(SCH_2COOCH_2CH_2OCOCH_2S)_2$, $(C_8H_{17})_2Sn(SCH_2COOCH_2CH_2CH_2CH_2OCOCH_2S)_2$, $(C_8H_{17})_2Sn(SCH_2COOC_8H_{17})_2$, $(C_8H_{17})_2Sn(SCH_2COOC_{12}H_{25})_2$,

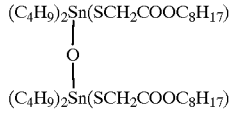

and the like; organic tin compounds of sulfide type, such as

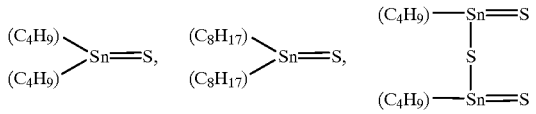

and the like; the reaction products of organic tin oxides, such as $(C_4H_9)_2SnO$, $(C_8H_{17})_2SnO$, $(C_4H_9)_2SnO$, $(C_8H_{17})_2SnO$ and the like and esters, such as ethyl silicate, ethyl silicate 40, dimethyl maleate, diethyl maleate, dioctylphthalate and the like.

As the curing accelerator (2), the chelate compound of the metal selected from the group consisting of zirconium, titanium and aluminum [hereinafter referred to as the metallic chelate compound (II)] can be mentioned.

As the metallic chelate compound (II), the compounds represented by the following general formula, the partially hydrolyzed products of these compounds and the like are exemplified:

$$Zr(OR^3)_p(R^4COCHCOR^5)_{4-p}$$

$$Ti(OR^3)_q(R^4COCHCOR^5)_{4-q}$$

$$Al(OR^3)_r(R^4COCHCOR^5)_{3-r}$$

In the above formulae, $R^3$ and $R^4$ indicate independently monovalent hydrocarbon radical having $C_1$–$C_6$, such as ethyl group, n-propyl group, i-propyl group, n-butyl group, sec-butyl group, t-butyl group, n-pentyl group, n-hexyl group, cyclohexyl group, phenyl group and the like, $R^5$ indicates the same monovalent hydrocarbon radical having $C_1$–$C_6$ as those indicated by $R^3$ and $R^4$ as well as alkoxy group having $C_1$–$C_{16}$, such as methoxy group, ethoxy group, n-propoxy group, n-butoxy group, sec-butoxy group, t-butoxy group, lauryloxy group, stearyloxy group and the like, p and q is an integer of 0–3, and r is an integer of 0–2.

As the concrete examples of these metallic chelate compounds (II), the following compounds are mentioned:
zirconium chelate compounds, such as tri-n-butoxy ethylacetoacetate zirconium,
di-n-butoxy bis(ethylacetoacetate)zirconium,
n-butoxy tris(ethylacetoacetate)zirconium,
tetrakis(n-propylacetoacetate)zirconium,
tetrakis(acetylacetoacetate)zirconium,
tetrakis(ethylacetoacetate)zirconium and the like;
titanium chelate compounds, such as
di-i-propoxy bis(ethylacetoacetate)titanium,
di-i-propoxy bis(acetylacetate)titanium,
di-i-propoxy bis(acetylacetone)titanium and the like;
aluminum chelate compounds, such as
di-i-propoxy ethylacetoacetate aluminum,
di-i-propoxy acetylacetonate aluminum,
i-propoxy bis(ethylacetoacetate)aluminum,
i-propoxy bis(acetylacetonate)aluminum,
tris(ethylacetoacetate)aluminum, tris(ethylacetate) aluminum,
tris(acetylacetonate)aluminum, monoacetylacetonate bis(ethylacetoacetate)aluminum and the like.

Among the aforementioned curing accelerators (1) and (2), tris(cyclohexylamino)methylsilane, tri-n-butoxy ethylacetoacetate zirconium, di-i-propoxy bis(acetylacetonate) titanium, di-i-propoxy ethylacetoacetate aluminum and tris (ethylacetoacetate)aluminum are preferred.

From the viewpoints of a layer strength and a pot life of the coating solution for the surface protective layer, the adding amounts of the aforementioned curing accelerators (1) and (2) are 0.1–15 parts by weight, preferably 0.5–10 parts by weight in relation to 100 parts by weight of the thermosetting silicone resin. These curing accelerators (1) and (2) may be used independently or may be used as a mixture of two or more of said curing accelerators. In the case where two or more of these compounds are employed, their adding amounts may be adjusted in such a way that their total amounts are fallen within the aforesaid range.

In the present invention, the coating solution for the surface protective layer is not precluded from containing the publicly known inorganic fine particles and organic fine particles. The hardness and roughness of the organic photosensitive layer can be adjusted by adding the inorganic and organic fine particles to said coating solution. The coating solution for the surface protective layer contains fundamentally only the thermosetting silicone resin as the resinous component which is a binder for forming the surface protective layer. However, not more than 10% by weight, preferably not more than 5% by weight of a thermoplastic resin based on the thermosetting silicone resin may be added to the coating solution for the surface protective layer.

The coating solution for the surface protective layer can be obtained by sufficiently mixing the aforementioned materials by means of the publicly known mixing equipment. More particularly, said coating solution can be prepared by mixing said materials until the thermosetting silicone resin is dissolved in the solvent and all the materials are uniformly mixed, for example, for more than 24 hours, preferably more than 48 hours by means of a sand mill.

The viscosity of the coating solution is adjusted in such a way that the thickness of the surface protective layer to be formed is fallen within the aftermentioned range and the uniform surface protective layer is formed.

The application method of the coating solution for the surface protective layer on the organic photosensitive layer is not restricted in particular insofar as the thickness of the formed surface protective layer can be controlled within 0.03–5 μm, preferably 0.1–3 μm and the surface protective layer can uniformly be formed. The publicly known method, such as brushing method, spray coating method, immersion method, roll coating method, flow-coating method, vacuum coating method, air-knife coating method, doctor blade coating method and the like may be adopted. These coating methods can be carried out by batch mode, semicontinuous mode or continuous mode.

In the present invention, an application of the aforesaid coating solution for the surface protective layer brings about the phenomenon that at least the resinous component of the organic photosensitive layer is eluted into the applied surface protective layer, and other materials of the organic photosensitive layer, such as the charge generating material, the charge transporting material and the like penetrate into the surface protective layer simultaneously. The materials of the organic photosensitive layer which are penetrated into the surface protective layer may exist in any state. In other words, said materials may exist within the surface protective layer in a dissolved state or in a dispersed state. In the present invention, it is preferable that the materials other than the binder resin of the organic photosensitive layer exist within the surface protective layer in a dissolved state. According to the present invention, the materials of the organic photosensitive layer can uniformly be penetrated into the surface protective layer without forming the ununiform interface between the surface protective layer and the organic photosensitive layer. As the result, it is thinkable that the adhesion between the surface protective layer and the organic photosensitive layer as well as the electrostatic properties, such as the sensitivity and the like are improved, and the occurrence of the image noise can be prevented over a long period of time.

After the coating solution for the surface protective layer is applied on the organic photosensitive layer, the curing treatment is carried out. In the curing process, the thermosetting silicone resin is cured, and preferably the structure wherein the siloxane bond is three-dimensionally repeated is formed. More particularly, it is desirable to cure said resin under the condition that the organic photosensitive layer on which said coating solution is applied is left to stand at not more than 130° C., preferably 100–125° C. for 10–120 minutes, preferably 30–60 minutes from the viewpoints of a curing efficiency of the thermosetting silicone resin, a prevention of residence of the solvent and a prevention of deterioration of the organic photosensitive layer.

The aforementioned photosensitive member of the present invention which is prepared by forming the surface protective layer on the organic photosensitive layer has a gradient of the ionization potential energy (hereinafter referred to as IPE) (eV) in the inside of the surface protective layer. More particularly, the photosensitive member of the present invention satisfies the following relationship:

$$\text{IPE (OCL inside)} < \text{IPE (OCL surface)}$$

wherein "IPE (OCL surface)" and "IPE (OCL inside)" represent IPE of the surface protective layer and IPE of the inside of the surface protective layer respectively.

Preferably the photosensitive member of the present invention satisfies the following relationship:

$$\text{IPE (OCL inside)} < \text{IPE (OCL surface)} - 0.15;$$

more preferably $$\text{IPE (OCL inside)} < \text{IPE (OCL surface)} - 0.20$$

wherein "IPE (OCL inside)" represents IPE at a depth of Y μm from the surface of the surface protective layer whose thickness is X μm ($X/2 \leqq Y < X$).

More particularly, the photosensitive member of the present invention satisfies the following relationship:

$$\text{IPE (PL surface)} < \text{IPE (OCL inside)} < \text{IPE (OCL surface)} \leqq \text{IPE (PL surface)} + 0.5$$

wherein "IPE (PL surface)" represents IPE of the surface of the photosensitive layer on which no surface protective layer is formed provided that IPE (PL surface) satisfies the following relationship:

$$5.3 \leqq \text{IPE (PL surface)} \leqq 5.7$$

When IPE (PL surface)≧IPE (OCL surface), no potential stability is obtained at the time of plate wearing, and an unevenness of the image density will occur.

When IPE (OCL surface)>IPE (PL surface)+0.5, a rising of electrification becomes worse, and the photosensitive member does not meet the needs of the market, such as a speeding up of the fast copying and a shortening of the reset time from a save mode for a consumption of electric power.

Although the values which are determined by means of AC-1 (Riken Co.) are employed as the ionization potential energy in the present specification, it does not necessarily determine said potential energy by means of said measuring equipment. Said potential energy may be determined by means of any measuring equipment insofar as it has the same measuring principle as that of the aforesaid measuring equipment. The ionization potential energy of the inside of the surface protective layer can be determined by applying the aforementioned measuring equipment to the surface of the surface protective layer, said surface being polished through a desired thickness by using the wrapping tape (LT-C2000; Fuji Shashin Film Co.) and the like.

The organic photosensitive layer on which the aforementioned surface protective layer can be formed may have any of the morphologies wherein (i) a charge generating layer and a charge transporting layer are laminated on the electroconductive support in this order, (ii) the charge transporting layer and the charge generating layer are laminated on the electroconductive support in this order, and (iii) a monolayer comprising a charge transporting material and a charge generating material is laminated on the electroconductive support. The organic photosensitive layer having the morphology wherein the charge generating layer and the charge transporting layer are laminated on the electroconductive support in this order will be illustrated hereinafter.

A foil or plate having the shape of drum made of cupper, aluminum, iron, nickel or the like is used as the electroconductive support. The electroconductive support which can be used may be prepared by forming the metal layer on the plastics layer and the like by vacuum spraying, spattering or electroless plating of these metals, or by forming the conductive layer on the paper or plastics layer by coating, vapor deposition or spattering of conductive compounds, such as a conductive polymer, indium oxide, tin oxide and the like. In general, cylindrical aluminum supports is used. More concretely, the following cylindrical supports are exemplified: ED pipe prepared by subjecting the aluminum material to extrusion molding and then to cold drawing molding; cutting pipe prepared by subjecting the aluminum material to extrusion molding and then to drawing molding to form an aluminum pipe, which is cut into parts whose outer surfaces are subjected to the finishing cut (about 0.2–0.3 mm) by means of cutting tools, such as diamond bite; EI pipe prepared by subjecting the aluminum disc to impact work to make the cup whose outer surface is subjected to the finishing wipe work; DI pipe prepared by subjecting the aluminum disc to deep drawing work to made the pipe whose outer surface is subjected to the finishing wipe work. These pipes may be used after they are subjected to the additional surface treatments by cutting or anodizing.

Although the charge generating layer and the charge transporting layer are laminated on these electroconductive support in this order, it is preferable to form the undercoat on the electroconductive support previously in order to prevent the charge injection from said support.

In the embodiment wherein the undercoat layer is formed on the electroconductive support, the suitable undercoat layer may be prepared by using the polymers themselves, such as polyimide, polyamide, nitrocellulose, polyvinyl butyral, polyvinyl alcohol, polyacrylate and the like, or the polymer compositions comprising any of the polymers as well as low resistant compounds, such as tin oxide, indium oxide and the like, or the deposited layers of aluminum oxide, zinc oxide, silicon oxide and the like. It is desirable to adjust the layer thickness of the undercoat to 1 $\mu$m and less.

The charge generating layer may be formed by (i) depositing the charge generating material under vacuum, (ii) coating the solution prepared by dissolving the charge generating materials in the solvents, such as amines and the like and then drying the coated solution, or (iii) coating the dispersion prepared by dispersing a pigment in a suitable solvent or the solution comprising a binder resin if necessary and then drying the coated dispersion.

As the charge generating materials, the following organic materials are exemplified: bisazo pigments, triarylmethane dyes, thiazine dyes, oxazine dyes, xanthene dyes, cyanine dyes, styryl dyes, pyrylium dyes, azo dyes, quinacridone dyes, indigo pigments, perylene pigments, polycyclic pigments, bisbenzimidazole pigments, indanthrone pigments, squalerium pigments, phthalocyanine pigments and the like. In addition, any other materials may be used insofar as they generate the charge carriers in extremely high efficiency when they absorb light.

It is preferable to form the charge transporting layer is formed by applying the coating solution prepared by dispersing the charge transfering material in the solution containing the binder resin, and then drying the coated solution.

As the charge transporting material, organic substances are preferred, and the following materials are exemplified: hydrazone compounds, phrazoline compounds, styryl compounds, triphenyl methane compounds, oxadiazole compounds, carbazole compounds, stilbene compounds, enamine compounds, oxazole compounds, triphenylamine compounds, tetraphenyl benzidine compounds, azine compounds and the like.

The binder resins used for the preparation of the aforementioned photosensitive member are the insulating resins. It is desirable that the insulating resins have a volume resistivity of not less than $1\times10^{12}\Omega\cdot$cm which is measured independently. For example, the publicly known thermoplastic resins, thermosetting resins, photosetting resins, photoconductive resins and the like may be used as the binder resins. The following resins are mentioned as the concrete examples of the binder resins: the thermoplastic resins, such as polyester resin, polyamide resin, acryl resin, ethylene-vinyl acetate resin, ionic crosslinked olefin copolymer (ionomer), styrene-butadiene block copolymer, polycarbonate, butyral resin, phenoxy resin, vinyl chloride-vinyl acetate copolymer, cellulose ester, polyimide, styrol resin and the like; the thermosetting resins, such as epoxy resin, urethane resin, silicone resin, phenol resin, melamine resin, xylene resin, alkyd resin, thermosetting acryl resin, and the like; photosetting resin; photoconductive resins, such as polyvinyl carbazole, polyvinyl pyrene, polyvinyl anthracene, polyvinyl pyrrole and the like. These binder resins may be used independently or may be used as a mixture of two or more of these resins.

In the case that the charge transporting materials themselves can be used as the binder, it is unnecessary to use another binder resins.

Together with the binder resins, plasticizers, such as halogenated paraffin, polybiphenyl chloride, dimethyl naphthalene, dibutyl phthalate, o-terphenyl and the like, electron-attracting sensitizer, such as chloranil, tetracyanoethylene, 2,4,7-trinitrofluorenone, 5,6-dicyanobenzoquinone, tetracyanoquinodimethane, tetrachloro phthalic anhydride, 3,5-dinitrobenzoic acid and the like, and sensitizers, such as methyl violet, rhodamine B, cyanine dye, pyrylium salt, thiapyrylium salt and the like may be added to the organic photosensitive layer.

The application of the photosensitive layer can be carried out by means of publicly known various coating equipments.

The aforementioned photosensitive member for electrophotography has excellent adhesion between the surface protective layer and the organic photosensitive layer, durability and electrostatic properties, such as sensitivity and the like, and can prevent the image noise over a long period of time.

As mentioned above, the object of the present invention can be achieved in the case where the organic photosensitive layer has the morphology wherein the charge transporting layer and the charge generating layer are laminated in this order. In this case, even if the charge generating layer on which the surface protective layer is directly formed is prepared by the vacuum deposition or the like in particular and contains no binder resin, the photosensitive member exhibits the improved adhesion between the surface protective layer and the charge generating layer as well as the electrostatic properties, such as sensitivity and the like and can prevent the occurrence of the image noise over a long period of time because the charge generating material which constitutes the charge generating layer is uniformly penetrated into the surface protecting layer by preparing said protective layer by using the aforementioned solvent.

EXAMPLES

In the following examples, "part" means "part by weight" unless otherwise indicated.

Example 1

Surface of the cylindrical aluminum alloy (JIS 5657) (outer diameter: 100 nm, length: 350 mm, thickness: 2 mm) was subjected to a cutting work by means of a bite equipped with natural diamond as a cutting blade. The cylindrical aluminum alloy was subjected to a degreasing treatment at 60±5° C. for 5 minutes using the surfactant "Top Alclean 101" (supplied by Okuno Pharmaceutical industrial Company) as a degreasing agent, and then washed with running water. The cylindrical aluminum alloy was subjected to an etching treatment wherein said alloy was immersed in the solution of nitric acid of 100 g/l for 5 minutes, and then washed with running water. Subsequently, the cylindrical aluminum alloy was subjected to an anodizing treatment [electrolytic solution: the solution of sulfuric acid of 150 g/l, current density: 1 A/dm$^2$, the temperature of the solution: 20° C.] for 15 minutes to form the anodized layer having a thickness of 8 $\mu$m, and washed with running pure water, and then subjected to a sealing treatment at 90° C. for 30 minutes using the aqueous solution of the sealing agent comprising nickel acetate (Sealing salt AS supplied by Clariant Japan Company) of 8 g/l. The photosensitive layer was formed on the substrate having the anodized layer which was subjected to the above sealing treatment according to the following procedure.

X-type phthalocyanine (8120B supplied by Dainihon Ink Kogyo Company) (4.5 parts), butyral resin (S-Lec BH-3 supplied by Sekisui Kagaku Company) (2.5 parts) and phenoxy resin (PKHH supplied by Union Carbide Company) (2.5 parts) were dispersed in dichloroethane (500 parts) by means of sand mill. The charge generating layer was formed by applying the obtained dispersion onto the above substrate in such a way that the layer thickness after dried becomes 0.3 $\mu$m.

Styryl compound represented the following formula (40 parts), polycarbonate resin (TS-2050 supplied by Teijin Kasei Company) (60 parts) and phenolic butyl hydroxytoluene (special grade reagent supplied by Tokyo Kasei Company) (2 parts) were dissolved in tetrahydrofuran (400 parts) to prepare the coating solution. The coating solution was applied onto the aforesaid charge generating layer, and then drying the applied solution to form the charge transporting layer having a thickness of 20 $\mu$m.

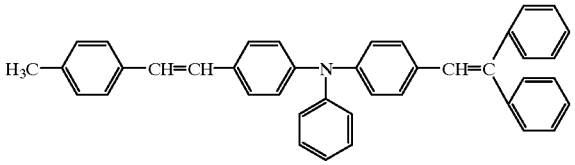

The coating solution for the surface protective layer was prepared by the following procedure.

Tris(cyclohexylamino)methylsilane which is a curing agent (2 parts) and 1,4-dioxane which is a solvent (special grade reagent supplied by Tokyo Kasei Company) (20 parts) were added to thermosetting silicone resinous solution (NP730 supplied by Nippon Dagrosham Rock Company) (100 parts), and these components were mixed by means of a sand mill for 48 hours to prepare the coating solution for the surface protective layer. The photosensitive member for electrophotography was prepared by applying said coating solution on the aforementioned charge transporting layer in such a way that a layer thickness becomes 2 $\mu$m after drying and then subjecting the applied solution to a heat-curing treatment at 100° C. for 30 minutes to form the surface protective layer.

Example 2

The photosensitive member for electrophotography was prepared by the same manner as described in Example 1 except that tetrahydrofuran was used as the solvent and that the coating solution for the surface protective layer was applied on the charge transporting layer and then the applied coating solution was subjected to a heat-curing treatment at 120° C. for 10 minutes to form the surface protective layer.

Example 3

The photosensitive member for electrophotography was prepared by the same manner as described in Example 1 except that toluene was used as the solvent and that the coating solution for the surface protective layer was applied on the charge transporting layer and then the applied coating solution was subjected to a heat-curing treatment at 120° C. for 10 minutes to form the surface protective layer.

Comparative Example 1

The photosensitive member for electrophotography was prepared by the same manner as described in Example 1 except for using 2-propanol as the solvent.

Comparative Example 2

The photosensitive member for electrophotography was prepared by the same manner as described in Example 1 except for using n-hexane as the solvent.

Comparative Example 3

The photosensitive member for electrophotography was prepared by the same manner as described in Example 1 except for using cyclohexanone as the solvent.

Comparative Example 4

The photosensitive member for electrophotography was prepared by the same manner as described in Example 1 except for using dichloromethane as the solvent.

Comparative Example 5

The photosensitive layer for electrophotography was prepared by the same manner as described in Example 1 except for using acetone as the solvent.

Comparative Example 6

The photosensitive member for electrophotography was prepared by the same manner as described in Comparative Example 1 except that the coating solution for the surface protective layer was prepared by dispersing acrylpolyolurethane PG60 (supplied by Kansai Paint Company)(20 parts) and polyamide resin (CM8000 supplied by Toray Company)(2 parts) in the solvent.

Evaluation

Electrostatic Properties

The obtained photosensitive members were installed into the commercially available electrophotographic copying machine (Di620 manufactured by Minolta Company) and charged with electricity (−6KV), and then an initial surface electric potential [VO(V)], a ratio of an exposure dose required to make the initial surface electric potential half-value (sensitivity [E1/2 ($\mu$J/cm$^2$)]) and a value of Vi (1.5 $\mu$J/cm$^2$) were measured.

Each of these factors is represented by a mean value of the measured values at three arbitrary points of one photosensitive member. It is concluded that the photosensitive member prepared in Comparative Example 4 exhibits a variability of quality because the difference between the maximum and minimum values of VO, E1/2 or Vi of said member exceeds 50% of the mean value. The difference between the maximum and minimum values of these factors of the photosensitive member prepared in Examples 1, 2 or 3 is within 5% of the mean value.

Adhesion

An adhesion of the obtained photosensitive member was evaluated according to JIS K5400.

The adhesion of the surface protective layer to the photosensitive layer in each of the aforementioned photosensitive members was measured by examining a peeling state of the surface protective layer in each of the photosensitive members at the time when an adhesive tape, which was sticked over the checkers formed by scratching the surface of each photosensitive member with a cutter knife at a pitch of 1 mm within one centimeter square in its early stage after it was made, was instantaneously peeled from said surface.

The standards for evaluating the adhesion of the surface protective layer are as follows:

10 Each scratch is a fine line whose both sides are smooth, and no peeling appears at an intersecting point of the scratches and each square.

8 Although a slight peeling is observed at the intersecting points of the scratches, no peeling appears at each square, and an area of defective parts does not exceed 5% of the total area of the squares.

6 Peeling is observed at the both sides and the intersecting points of the scratches, and the area of the defective parts is 5–15% of the total area of the squares.

4 A width of the peeling at the scratches is broad and the area of the defective parts is 15–35% of the total area of the squares.

2 The width of the peeling at the scratches is broader than that of the standard "4" and the area of the defective parts is 35–65% of the total area of the squares.

0 The area of the total defective parts due to the peeling is 65% and more of the total area of the squares.

The adhesion is represented by a mean value of the evaluation results at three arbitrary places of one photosensitive member. It is concluded that the photosensitive member prepared in Comparative Example 4 exhibits a variability of quality because the difference between the maximum and minimum values of the evaluation results concerning the adhesion is 8. As regards the evaluation result concerning the adhesion of each photosensitive member prepared in Examples 1–3, the difference between the maximum and minimum values is 0.

Image Noise

The image noise caused by each of the photosensitive members was evaluated by the following method. Each of the photosensitive member was installed into the commercially available electrophotographic copying machine (Di620 manufactured by Minolta Co., Ltd.), and the image having B/W ratio of 5% was successively copied 10000 times, and then the copied image was evaluated by a visual observation in respect of the fog, image flowing and image shading. The evaluation was conducted under the circumstances of the low temperature and humidity (10° C., 15%), intermediate temperature and humidity (23° C., 45%) and high temperature and humidity (30° C., 85%).

The standards for evaluating the image noise are as follows:

"0": None of the fog, image flowing and image shading occurs on the copied image.

"F": The fog occurs on the copied image.

"I.F.": The image flowing occurs on the copied image.

"I.S.": The image shading occurs on the copied image.

The results obtained are summarized in Table 1. In Comparative Examples 2 and 5, no photosensitive member was prepared because of a gelation of the coating solution for the surface protective layer. In Comparative Example 4, the evaluations concerning the sensitivity and image noise were not conducted because the photosensitive member exhibits the variability of quality.

TABLE 1

| | Solvent | | | Electrostatic properties | | | | Image noise | | | | | |
|---|---|---|---|---|---|---|---|---|---|---|---|---|---|
| | | | | | | | | 10° C./15% | | 23° C./45% | | 30° C./85% | |
| | Kind | S.P. (1) | b.p. (° C.) | VO | E½ | Vi | Adhesion | Initial stage | (2) | Initial stage | (2) | Initial stage | (2) |
| Ex. 1 | Dioxane | 9.8 | 101 | −605 | 0.42 | 158 | 8 | O | O | O | O | O | O |
| Ex. 2 | Tetrahydrofuran | 9.1 | 66 | −610 | 0.44 | 164 | 8 | O | O | O | O | O | O |
| Ex. 3 | Toluene | 8.9 | 111 | −600 | 0.46 | 166 | 8 | O | O | O | O | O | O |
| Com. Ex. 1 | 2-Propanol | 11.5 | 82 | −610 | 0.52 | 230 | 0 | O | O | O | O | O | I.F. |
| Com. Ex. 2 | n-Hexane | 7.3 | 69 | — | — | — | — | — | — | — | — | — | — |
| Com. Ex. 3 | Cyclohexanone | 9.9 | 155 | −605 | 0.5 | 206 | 0 | O | O | O | O | O | I.F. |
| Com. Ex. 4 | Dichloromethane | 9.7 | 40 | — | — | — | 0–8 | — | — | — | — | — | — |
| Com. Ex. 5 | Acetone | 9.4 | 56 | — | — | — | — | — | — | — | — | — | — |
| Com. Ex. 6 | none | — | — | −600 | 0.52 | 240 | 8 | F | — | O | O | I.S. | I.F. |

(1) Solubility parameter
(2) After the image was copied 10000 times.

Ionization Potential Energy

The ionization potential energy on the surface or in the inside of the surface protective layer of each photosensitive member was determined by means of AC-1 manufactured by Riken Company. The inside of the surface protective layer was exposed by polishing the surface of said layer through about 1.5 $\mu$m by means of the wrapping tape (LT-C2000 supplied by Fuji Shashin Film Company), and the exposed surface was subjected to the measurement of the ionization potential energy. The ionization potential energy on the surface of the organic photosensitive layer was 5.45 eV.

The results obtained are summarized in Table 2.

TABLE 2

| | Ionization potential energy (eV) | |
|---|---|---|
| | Surface | Inside |
| Ex. 1 | 5.74 | 5.47 |
| Ex. 2 | 5.74 | 5.5 |
| Ex. 3 | 5.74 | 5.5 |
| Com. Ex. 1 | 5.74 | 5.74 |
| Com. Ex. 2 | — | — |
| Com. Ex. 3 | 5.74 | 5.74 |
| Com. Ex. 4 | — | — |
| Com. Ex. 5 | — | — |
| Com. Ex. 6 | 5.72 | 5.72 |

The photosensitive member for electrophotography according to the present invention has excellent adhesion between the surface protective layer and the organic photosensitive layer, durability and electrostatic properties, such as sensitivity and the like, and can prevent the image noise under any circumstance over a long period of time.

What is claimed is:

1. A photosensitive member for electrophotography which comprises:

(i) an electroconductive support, (ii) an organic photosensitive layer which comprises a charge generating material, a charge transporting material, and a binder resin, and (iii) a surface protective layer which comprises a thermosetting silicone resin, said surface protective layer being prepared by applying a coating solution comprising the thermosetting silicone resin and a solvent, which can dissolve the binder resin and has a boiling point of 60–130° C. and a solubility parameter of 8–11, onto the organic photosensitive layer and then curing the applied coating solution, wherein a region of the surface protective layer situated on a side of the organic photosensitive layer comprises the binder resin of the organic photosensitive layer.

2. The photosensitive member for electrophotography of claim 1, wherein the solvent has a boiling point of 60–120° C. and a solubility parameter of 8.5–10.5.

3. The photosensitive member for electrophotography of claim 1, wherein the solvent has a boiling point of 65–115° C. and a solubility parameter of 8.5–10.

4. The photosensitive member for electrophotography of claim 1, wherein the thermosetting silicone resin is a polycondensate of an organosilane represented by the following general formula (I):

$$(R^1)_nSi(OR^2)_{4-n} \quad (I)$$

wherein $R^1$ is an organic group having $C_1$–$C_8$, $R^2$ is an alkyl group having $C_1$–$C_5$ or an acyl group having $C_1$–$C_4$, and n is an integer of 0–2.

5. The photosensitive member for electrophotography of claim 1, wherein the coating solution comprises a curing accelerator.

6. The photosensitive member for electrophotography of claim 1, wherein the organic photosensitive layer is a monolayered photosensitive layer which comprises the charge generating material, the charge transporting material and the binder resin.

7. The photosensitive member for electrophotography of claim 6, wherein the region of the surface protective layer comprises the binder resin, the charge generating material and the charge transporting material.

8. The photosensitive member for electrophotography of claim 1, wherein the organic photosensitive layer is a laminated photosensitive layer which consists of (i) a charge generating layer comprising the charge generating material and (ii) a charge transporting layer comprising the charge transporting material and the binder resin.

9. The photosensitive member for electrophotography of claim 8, wherein the region of the surface protective layer comprises the binder resin and the charge transporting material.

10. The photosensitive member for electrophotography of claim 1, wherein it has an undercoat layer between the electroconductive layer and the photosensitive layer.

11. A photosensitive member for electrophotography comprising:

(i) an electroconductive support, (ii) an organic photosensitive layer comprising a charge generating material, a charge transporting material and a binder resin, and (iii) a surface protective layer comprising a thermosetting silicone resin and being formed on the organic photosensitive layer, wherein a region of the surface protective layer situated on a side of the organic photosensitive layer comprises the binder resin of the organic photosensitive layer; wherein an ionization potential of a surface of the organic photosensitive layer (1st IPE), an ionization potential of an inside region of the surface protective layer which is situated on a side of the organic photosensitive layer (2nd IPE), and an ionization potential of a surface of the surface protective layer (3rd IPE) satisfy the following relationship:

$$\text{1st IPE} < \text{2nd IPE} < \text{3rd IPE}.$$

12. The photosensitive member for electrophotography of claim 11, wherein 1st IPE is 5.3–5.7 eV.

13. The photosensitive member for electrophotography of claim 11, wherein 2nd IPE and 3rd IPE satisfy the following relationship:

$$\text{2nd IPE} < \text{3rd IPE} - 0.15 \text{ eV}.$$

14. The photosensitive member for electrophotography of claim 11, wherein 2nd IPE and 3rd IPE satisfy the following relationship:

$$\text{2nd IPE} < \text{3rd IPE} - 0.20 \text{ eV}.$$

15. The photosensitive member for electrophotography of claim 11, wherein 1st IPE and 3rd IPE satisfy the following relationship:

$$\text{3rd IPE} \leqq \text{1st IPE} + 0.5 \text{ eV}.$$

16. The photosensitive member for electrophotography of claim 11, wherein the organic photosensitive layer is a monolayered photosensitive layer which comprises the charge generating material, the charge transporting material and the binder resin.

17. The photosensitive member for electrophotography of claim 16, wherein the region of the surface protective layer comprises the binder resin, the charge generating material and the charge transporting material.

18. The photosensitive member for electrophotography of claim 11, wherein the organic photosensitive layer is a laminated photosensitive layer which consists of (i) a charge generating layer comprising the charge generating material and (ii) a charge transporting layer comprising the charge transporting material and the binder resin.

19. The photosensitive member for electrophotography of claim 18, wherein the region of the surface protective layer comprises the binder resin and the charge transporting material.

20. A process for preparing a photosensitive member for electrophotography which comprises:

(i) forming an organic photosensitive layer which comprises a charge generating material, a charge transforming material, and a binder resin, (ii) forming a surface protective layer on the organic photosensitive layer including applying a coating solution which comprises a thermosetting silicone resin and a solvent, which can dissolve the binder resin and has a boiling point of 60–130° C. and a solubility parameter of 8–11, onto the organic photosensitive layer and then curing the applied coating solution, wherein a region of the surface protective layer situated on a side of the organic photosensitive layer comprises the binder resin of the organic photosensitive layer, and (iii) heating the applied coating solution to cure the thermosetting silicone resin.

* * * * *